United States Patent [19]

Longerich

[11] 4,262,595

[45] Apr. 21, 1981

[54] ANTI TORPEDO DEVICE

[75] Inventor: Ernest P. Longerich, Chatsworth, Calif.

[73] Assignee: The Singer Company, Stamford, Conn.

[21] Appl. No.: 950,653

[22] Filed: Oct. 12, 1978

[51] Int. Cl.[3] ..... F42B 22/00

[52] U.S. Cl. ..... 102/10

[58] Field of Search ..... 102/10, 13, 17; 89/36 AE, 36 J, 36 N; 114/240 R, 240 A, 240 D

[56] References Cited

U.S. PATENT DOCUMENTS

| | | | |
|---|---|---|---|
| 1,278,602 | 9/1918 | D'Amico | 102/10 |
| 1,337,920 | 4/1920 | Kohler | 102/10 |
| 3,543,684 | 12/1970 | Radford | 102/10 |

*Primary Examiner*—Charles T. Jordan

*Attorney, Agent, or Firm*—Robert E. Smith; Edward L. Bell

[57] ABSTRACT

A collapsed barrier is placed in the water in the general path of a detected homing torpedo after which the barrier is erected into one or more generally vertical planes to intercept the torpedo. When the torpedo strikes the barrier an explosive charge is detonated to destroy the torpedo.

28 Claims, 6 Drawing Figures

ANTI TORPEDO DEVICE

BACKGROUND OF THE INVENTION

A live torpedo approaching a ship is best eliminated by utilizing an explosive to destroy the torpedo. Placing the explosive in close proximity to the torpedo, however, is a problem. In the case of homing torpedoes, the torpedoes can be decoyed to an area containing explosives by the use of acoustic signals from an acoustransducer. Once the torpedo arrives in the vicinity of the explosive, however, the problem remains as to when to detonate the explosive as the torpedo passes. Using acoustic signals to determine the location of the torpedo has generally proven unsuccessful because of the interference from the decoying signals which are attracting the torpedo to the vicinity of the explosives. Other approaches, such as the use of magnetics, have not been able to accurately determine miss distances in order to insure a high degree of torpedo neutralization. Accordingly, one object of this invention is to provide an improved anti torpedo system.

Another object of this invention is to provide an improved anti torpedo system wherein acoustics are not utilized to determine the location of the torpedo with relation to an explosive charge.

Still another object of this invention is to provide an anti torpedo device which includes a barrier located in the path of travel of the torpedo to be neutralized.

A further object of this invention is to provide an improved anti torpedo system wherein homing torpedoes are decoyed into a fused barrier surface to set off an explosive charge which destroys the torpedo.

BRIEF SUMMARY OF THE INVENTION

Briefly described, the present invention of an anti torpedo device includes an elongated flexible support member. A plurality of flat, flexible barrier members each having one edge thereof secured to the elongated support member. Means are connected to each of the barrier members to enable each barrier member to be disposed in a substantially flat, generally vertical plane with the barrier members being generally equally spaced around the elongated support member. Sensing means responsive to the device being immersed in water activates the means for causing the barrier members to be disposed in a generally vertical plane. Each barrier member contains torpedo sensing means that provide an indication whenever a torpedo strikes a barrier member. At least one explosive charge is associated with the anti torpedo device and is preferrably secured to the elongated flexible support member. Detonating means coupled between the explosive charge and the torpedo sensing means causes the explosive charge to detonate and destroy the torpedo whenever a torpedo strikes a barrier member.

BRIEF DESCRIPTION OF THE DRAWINGS

The various features, objects and advantages of the present invention will be readily apparent from the following detailed description taken in conjunction with the following drawings, wherein like reference characters designate like or corresponding parts throughout the several views, and wherein.

DETAILED DESCRIPTION OF THE INVENTION

Figure 1:
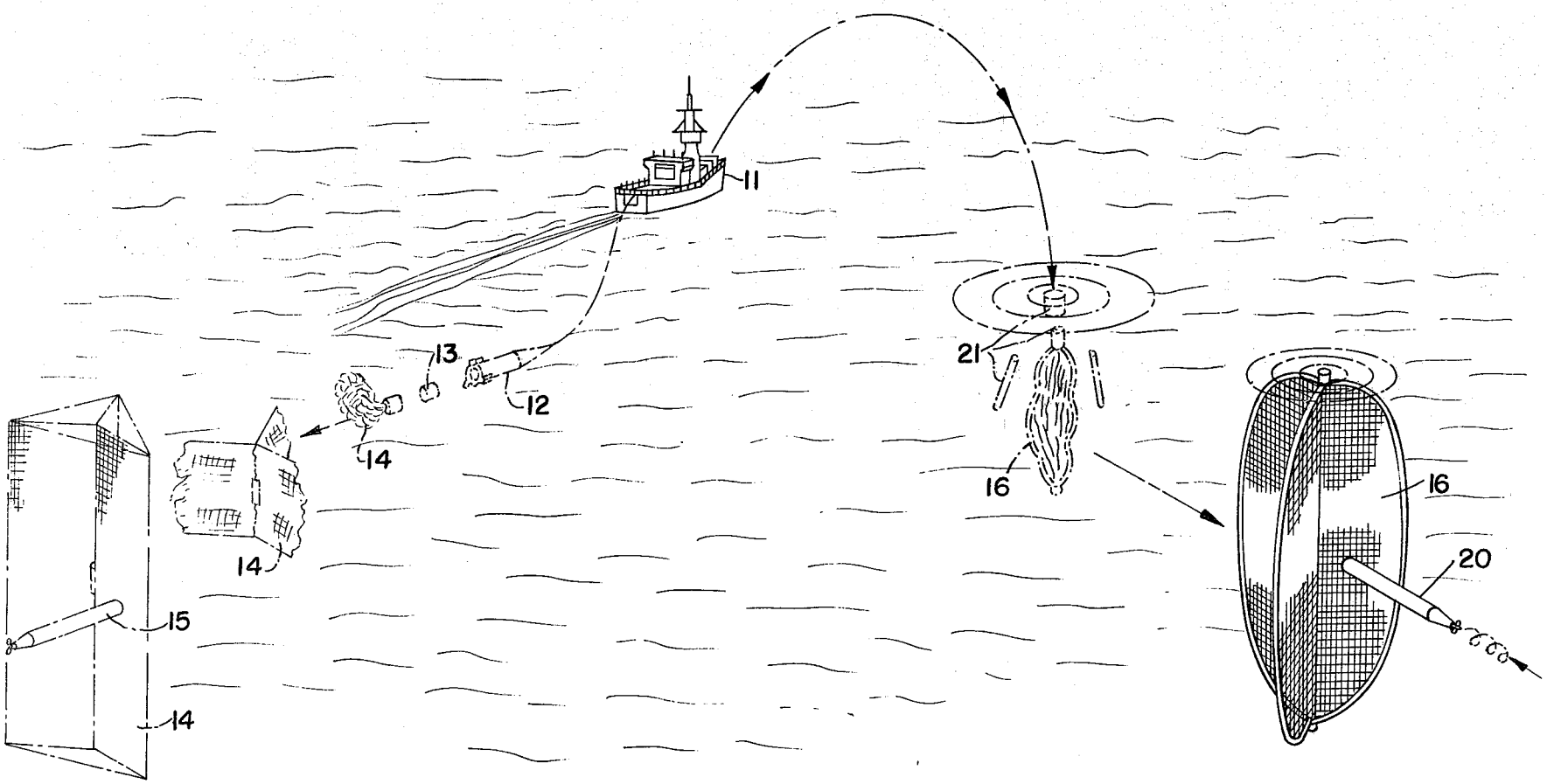
FIG. 1 illustrates a sea borne anti torpedo system which utilizes the present invention.

A sea borne anti torpedo system which may utilize the present invention is shown in FIG. 1. When the defense system of a ship 11 detects an oncoming torpedo 20 a rocket 21 is fired into the path of the torpedo 20. Once the rocket 21 enters the water, explosive bolts thereon cause the rocket housing to split into various sections thereby releasing a folded barrier 16 into the water. As described below in detail, the barrier 16 includes inflating means which causes the barrier 16 to be erected in a generally vertical plane. When the barrier 16 is impacted by the torpedo 20 a fuse is actuated which detonates an explosive charge to destroy the torpedo 20. Depending upon the accuracy of the defense system of the ship 11, the barrier 16 may be utilized to protect the ship 11 against free running torpedoes. As a defense against homing torpedoes, however, the barrier 16 may include an acoustic transducer which causes the torpedo 20 to home onto the barrier 16.

In addition to being deployed by a rocket 21 a barrier device in accordance with the present invention may be deployed from a guided pod 12 which is towed by the ship 11. For example, the pod 12 may be guided below the wake of the ship 11 to protect against wake following torpedoes 15. Once such a torpedo 15 is sensed by the defense system of the ship 11 using sensors on the pod a cannister 13 is ejected from the pod 12 at the predicted track intercept coordinates. Upon entering the water the cannister 13, by means of explosive bolts, is caused to eject a folded barrier 14. By means described below, once the barrier 14 is immersed in the water, extension means cause the barrier 14 to be deployed in a generally vertical plane. The impact of the torpedo 15 on the barrier 14 will detonate an explosive to destroy the wake following torpedo 15.

Figure 2A:
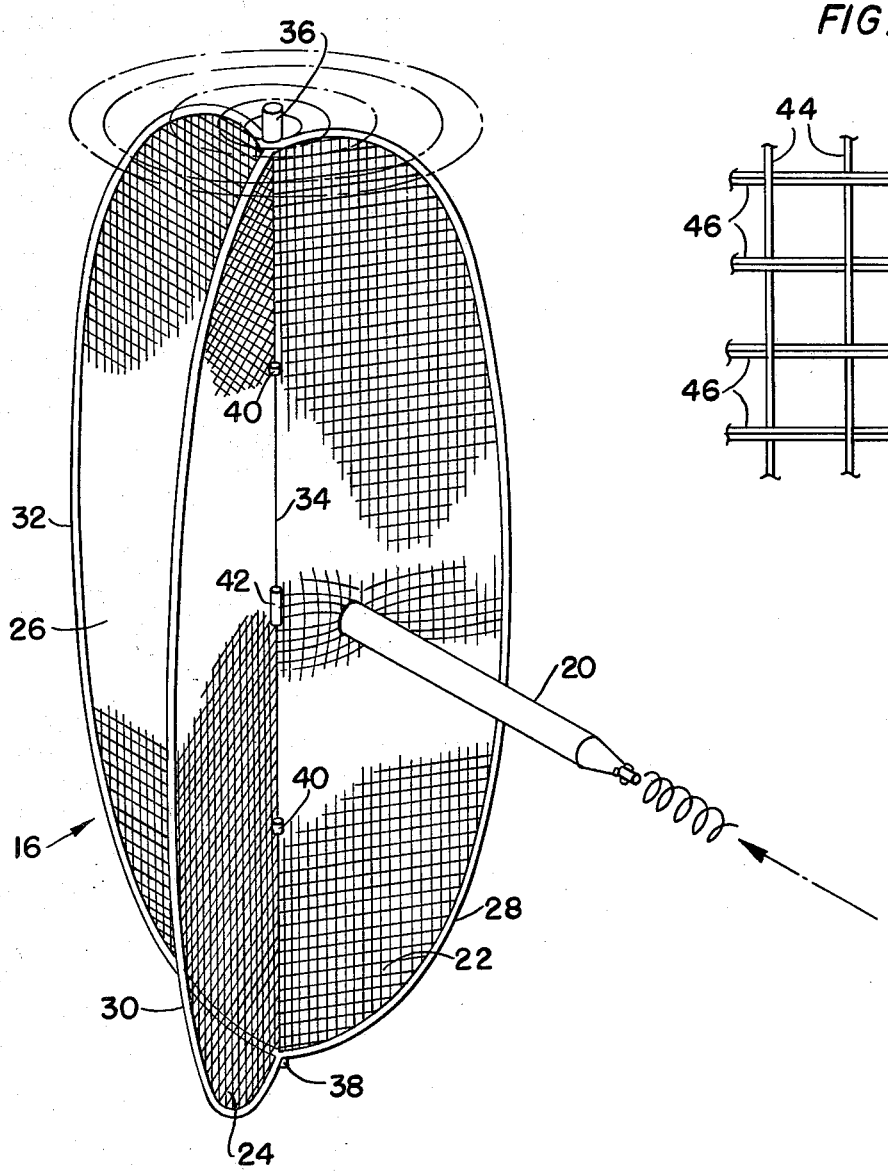
FIGS. 2A and 2B illustrate a barrier anti torpedo device in accordance with one embodiment of the present invention.
Figure 2B:
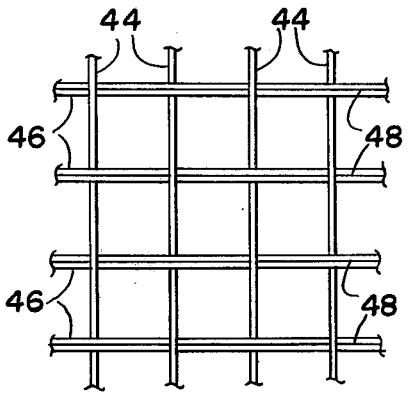

Referring now to FIGS. 2A and 2B, a barrier in accordance with the present invention is illustrated in detail as including an elongated flexible support member 34. Secured to the support member 34 are three (3) generally equally spaced barrier members or panels 22, 24 and 26. The outer periphery of each barrier member 22, 24 and 26 has secured thereto an inflatable rib 28, 30 and 32 respectively. Located adjacent the top of the support member 34 is inflation means 36 which inflats the ribs 28, 30 and 32 when the barrier member 16 is immersed in water. Upon becoming inflated the ribs 28, 30 and 32 cause the folded barrier panels 22, 24 and 26 to be spread out into substantially flat planes as illustrated. Located adjacent the bottom of the support member 34 is a weighted buoyancy control 38 which enables the barrier 16 to be oriented in a vertical plane. This is controlled by the weighted means 38 causing the center of buoyancy of the barrier 16 to be located above its center of gravity.

Secured to the flexible support member 34 near the center thereof is a package 42 which includes at least one acoustic transducer and the associated power supply and logic electronics therefore for causing homing torpedoes to impact the barrier 16. Located intermediate the acoustic transducer 42 and the ends of the flexible support member 34 are explosive charges 40. As shown in FIG. 2B, each barrier member 22, 24 and 26 includes a plurality of flexible vertical strips 44 and a plurality of horizontal strips 46. Embedded within or secured to the surface of the horizontal strips 46 is a continuous electrical conductor 48. Upon impact of a barrier member 22, 24 or 26 by a torpedo 20, the electrical conductor 48 is broken thereby causing an open circuit which is utilized to detonate the explosives 40 to destroy the torpedo 20 by operating appropriate fuzing circuitry.

The inflation control means 36 may include a regulated source of air pressure, a solid propellant gas generator or a motor operated water pump for inflating the ribs 28, 30 and 32 with sea water. Additionally, the barrier 16 is not limited to three barrier members 22, 24 and 26 but may contain any number of barrier members. The barrier 16 is shown as having a generally curved oblong shape in FIG. 2A, however, as will be apparent to those skilled in the art the general shape and outline of the barrier 16 can take any configuration.

By controlling the weight of the buoyancy control means 38, the barrier 16 is erected at a preselected depth. Two or more explosive charges 40 are employed to increase the depth coverage while reducing the total weight required for full affectiveness. The barrier 16 dimensions and explosive charge 40 weights are so sized that torpedo impact at any point results in destruction of the torpedo 20. By using three or more barrier members 22, 24 and 26, any orientation problems are eliminated. The barrier 16 can also be deployed from a submarine or an aircraft by parachute or rocket. The inflation means are preferably actuated by a water sensing device that senses when the barrier 16 becomes immersed in water.

Figure 3:
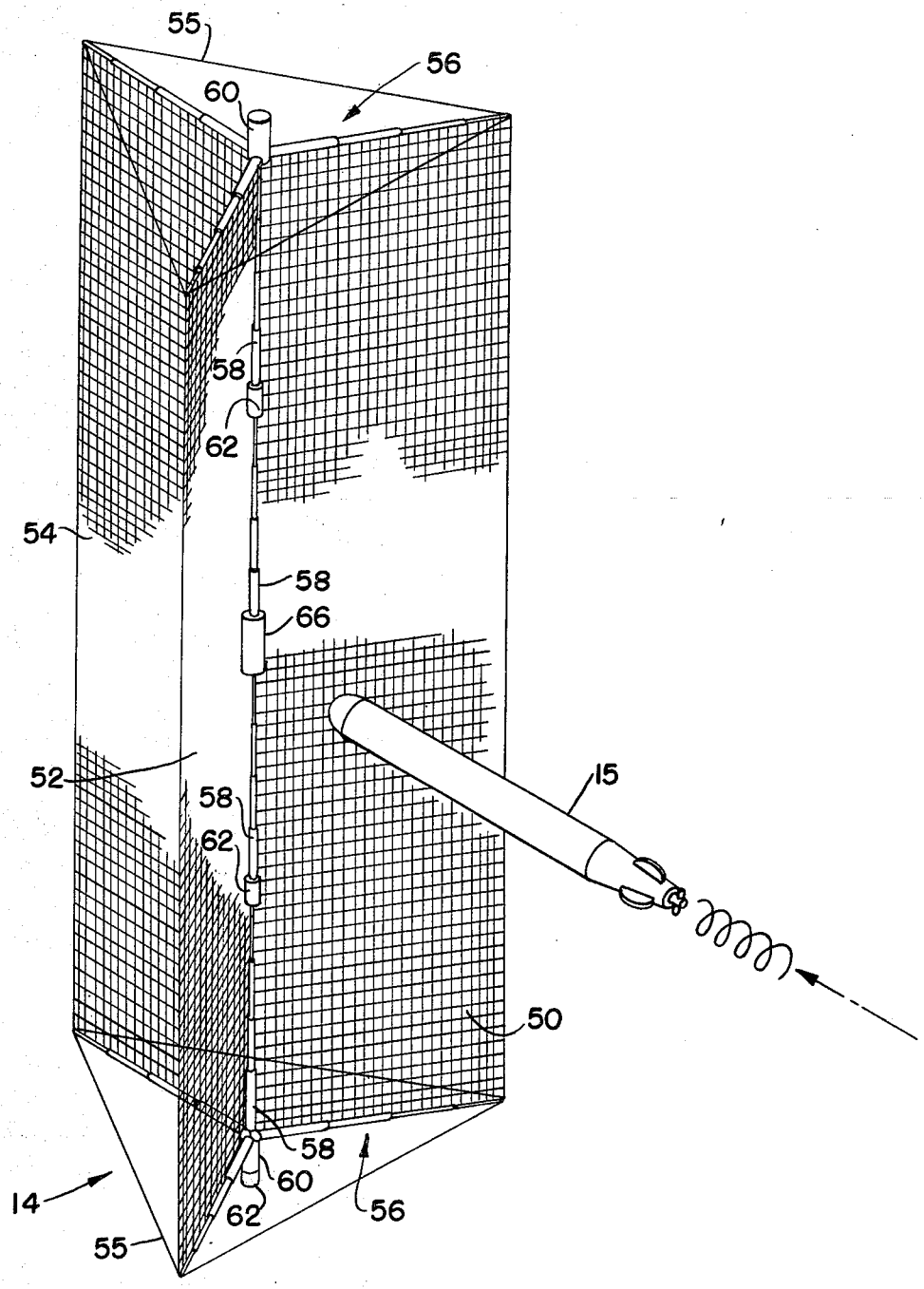
FIG. 3 illustrates a barrier type anti torpedo device in accordance with still another embodiment of the present invention.

Referring now to FIG. 3 another embodiment of the present invention is illustrated as including telescoped extension means 56 located on opposite ends of three rectangular barrier panels 50, 52 and 54. Extension control means 60 responsive to the barrier 14 being immersed in water are provided for extending the telescoped extension means 56 and weighted buoyancy control means 62 are provided for orienting the barrier 14 in a generally vertical plane at a preselected depth. extension means 56 such that the three barrier panels 50, 52 and 54 are generally equally spaced from one another. Vertical support for the barrier member 14 is provided by three telescoped extension means 58. Located near the center of the barrier 14 is an acoustic transducer 66 with the necessary power supply and logic electronics therefor. Explosive charges 62 are located between the acoustic transducer package 66 and the upper and lower ends of the barrier 14. In a manner discussed herein above in conjunction with FIG. 2B, each barrier panel member 50, 52 and 54 contains a continuous electrical conductor therein that is utilized as a fuse. Upon being struck by a torpedo 15, the breaking of the electrical conductor will cause the explosive charges 62 to be detonated to destroy the torpedo 15.

Figure 4:
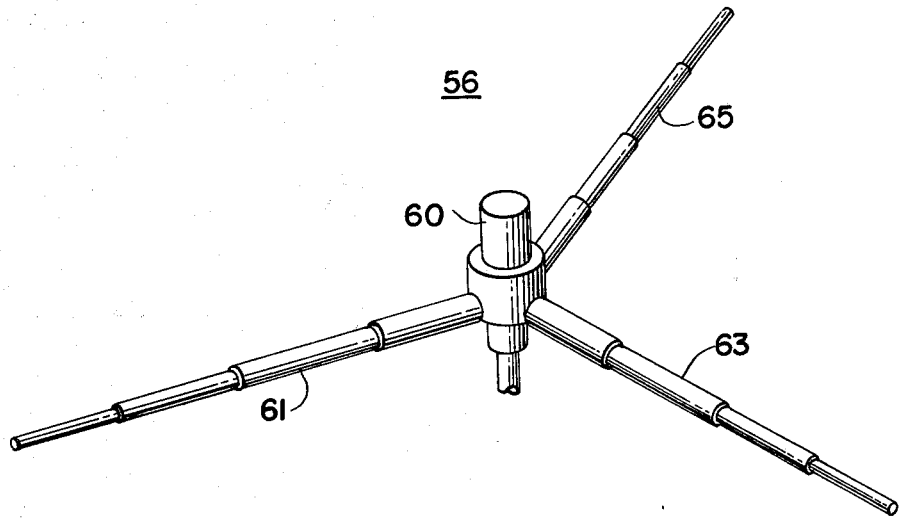
FIGS. 4 and 5 illustrate barrier extension means which may be utilized in the embodiment of FIG. 3.

The telescoping extension means 56 is illustrated in FIG. 4 as including three telescoping arms 61, 63 and 65. The source of power for 60 for extending the arms 61, 63 and 65 may include a gas generator, a source of regulated air pressure or a motor driven water pump to extend the arms 61, 63 and 65 with sea water.

Figure 5:
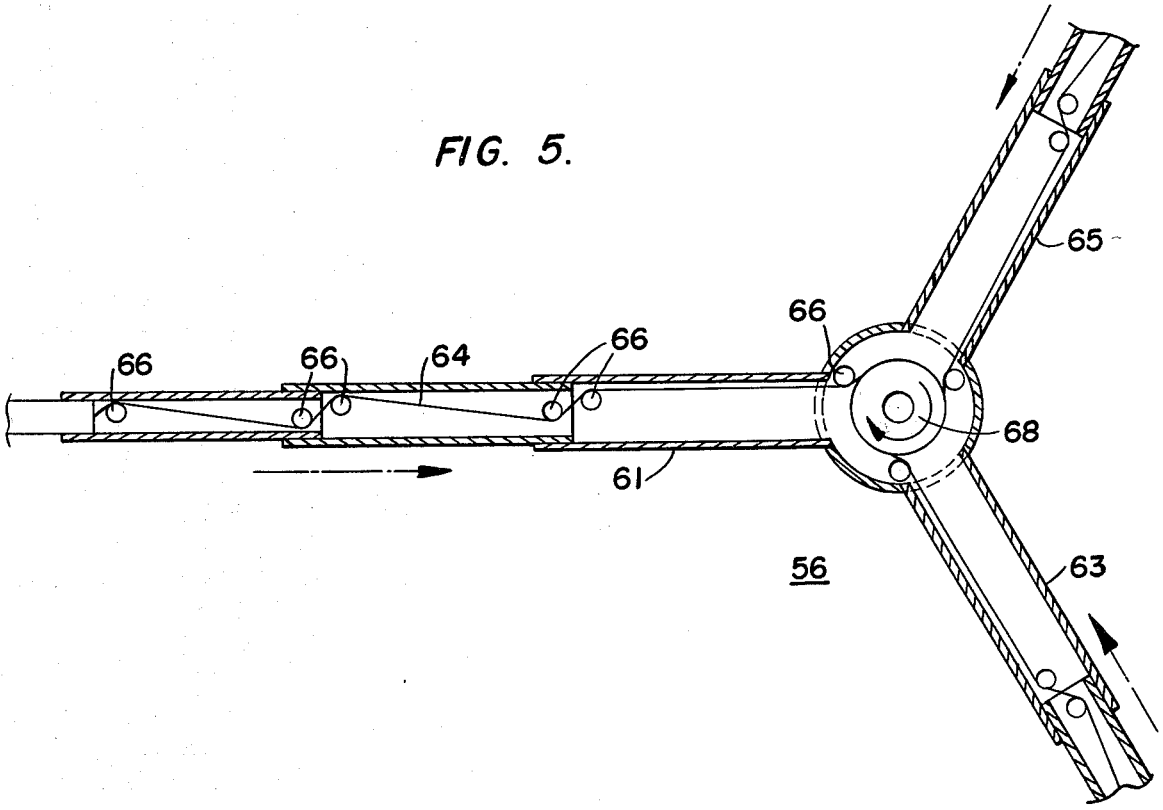

Another embodiment of the telescoping extension means 56 is illustrated in FIG. 5 as including a pantographic extension system which includes pulleys 66 and an actuating cable 64 in each telescoped arm 61, 63 and 65. The pantographic extension means is operated by a power source 68 which may include a spring motor or a battery powered electric motor. Since the telescoped tubes of the embodiment illustrated in FIG. 6 cannot be sealed, the water pressure within the telescoped tubes is equal to the water pressure surrounding the barrier device 14.

The three telescoped vertical sections 58 are extended in a manner similar to that discussed above in conjunction with FIGS. 4 and 5.

In the event that barrier 14 or 16 fails to destroy an incoming torpedo 20 or 15 respectively, means are provided to deactivate the barrier 14 or 16 and its explosive charges. This can readily be accomplished by having soluble plugs or bleeder holes throughout the system which cause the barrier devices 14 or 16 to sink after a predetermined period of time.

I claim:

1. An anti torpedo device comprising:

at least one flexible barrier member;

means connected to said barrier member to selectively cause said barrier member to be positioned in a substantially flat, generally vertical plane;

sensing means responsive to said device being immersed in water to activate said means for placing said barrier member in a generally vertical plane;

torpedo sensing means coupled to said barrier member and adapted to provide an indication whenever a torpedo strikes said barrier;

at least one explosive charge associated with said barrier; and means coupling said explosive charge to said torpedo sensing means to detonate said explosive whenever a torpedo strikes a said barrier.

2. The device according to claim 1 wherein;

said means to selectively position said barrier member includes an inflatable rib secured to at least a portion of the periphery of said barrier member.

3. The device according to claim 2 further including;

means to inflate said rib with gas.

4. The device according to claim 2 further including;

means to inflate said rib with sea water.

5. The device according to claim 1 wherein;

said barrier positioning means includes at least one mechanical extension means secured to a portion of the periphery of said barrier member.

6. The device according to claim 5 wherein;

said extension means includes telescoped tubes.

7. The device according to claim 6 wherein;

means are provided to extend said mechanical extension means with gas.

8. The device according to claim 6 wherein;

means are provided to extend said mechanical extension means with sea water.

9. The device according to claim 6 further including;

pantagraphic extension means secured within said telescoped tubes; and actuating means coupled to said pantagraphic means to extend said telescoped tubes.

10. An anti torpedo device comprising:

a plurality of flat, flexible barrier members;

each said barrier member having an equal length substantially straight portion thereon;

means securing said plurality of flexible barrier members to one another along said straight portion;

means connected to each of said barrier members to cause each said barrier member to be disposed in a substantially flat, generally vertical plane with said straight portion at the connection of said barrier members also being generally vertical with said barrier layers emanating from said vertical straight portion being substantially equally spaced from one another;

sensing means responsive to said device being immersed in water to activate said means for disposing said barrier members in a generally vertical plane;

torpedo sensing means coupled to at least one of said barrier members and adapted to provide a signal whenever a torpedo strikes a said barrier member;

at least one explosive charge associated with said barrier members; and means coupled between said explosive charge and said torpedo sensing means to detonate said explosive charge whenever a torpedo strikes a said barrier member.

11. The device according to claim 10 wherein;

said means to selectively position said barrier members includes an inflatable rib secured to at least a portion of the periphery of said barrier members.

12. The device according to claim 11 further including;

means to inflate said rib with gas.

13. The device according to claim 11 further including;

means to inflate said rib with sea water.

14. The device according to claim 10 wherein;

said barrier positioning means includes at least one mechanical extension means secured to a portion of the periphery of each said barrier members.

15. The device according to claim 14 wherein;

said extension means includes telescoped tubes.

16. The device according to claim 14 wherein;

means are provided to extend said mechanical extension means with gas.

17. The device according to claim 14 wherein;

means are provided to extend said mechanical extension means with sea water.

18. The device according to claim 15 further including;

pantagraphic extension means secured within said telescoped tubes; and actuating means coupled to said pantagraphic means to extend said telescoped tubes.

19. The device according to claim 10 wherein;

said torpedo sensing means includes an electrical conductor.

20. An anti torpedo device comprising an elongated, flexible support member;

a plurality of flat, flexible barrier members;

one edge of each of said barrier members being secured to said elongated support member;

means connected to each of said barrier members to enable each said barrier member to be disposed in a substantially flat, generally vertical plane with said barrier members being generally equally spaced around said elongated support member;

sensing means responsive to said device being immersed in water to activate said means for causing said barrier members to be disposed in a generally vertical plane;

torpedo sensing means coupled to each said barrier member and adapted to provide an indication whenever a torpedo strikes a said barrier member;

at least one explosive charge associated with said barrier members; and means coupled between said explosive charge and said torpedo sensing means to detonate said explosive charge whenever a torpedo strikes a said barrier member.

21. The device according to claim 20 wherein:

said means to selectively position said barrier members includes an inflatable rib secured to at least a portion of the periphery of said barrier members.

22. The device according to claim 21 further including:

means to inflate said rib with gas.

23. The device according to claim 21 further including:

means to inflate said rib with sea water.

24. The device according to claim 20 wherein:

said barrier positioning means includes at least one mechanical extension means secured to a portion of the periphery of said barrier members.

25. The device according to claim 24 wherein said extension means includes telescoping tubes.

26. The device according to claim 24 wherein means are provided to extend said mechanical extension means with gas.

27. The device according to claim 24 wherein means are provided to extend said mechanical extension means with sea water.

28. The device according to claim 25 further including pantagraphic extension means secured within said telescoped tubes; and actuating means coupled to said pantagraphic means for actuating said pantagraphic means to extend said telescoped tubes.

* * * * *